US006045908A

United States Patent [19]

Nakajima et al.

[11] Patent Number: 6,045,908

[45] Date of Patent: Apr. 4, 2000

[54] BIODEGRADABLE FIBER AND NON-WOVEN FABRIC

[75] Inventors: Yuji Nakajima, Shiga; Masahiko Taniguchi, Chiba, both of Japan

[73] Assignee: Chisso Corporation, Osaka, Japan

[21] Appl. No.: 08/894,059

[22] PCT Filed: Jan. 11, 1996

[86] PCT No.: PCT/JP96/00059

§ 371 Date: Aug. 12, 1997

§ 102(e) Date: Aug. 12, 1997

[87] PCT Pub. No.: WO96/25538

PCT Pub. Date: Aug. 22, 1996

[30] Foreign Application Priority Data

Feb. 14, 1995 [JP] Japan ..... 7-049228
Jun. 19, 1995 [JP] Japan ..... 7-176737

[51] Int. Cl.[7] ..... D02G 3/36; D01G 5/34

[52] U.S. Cl. ..... 428/373; 428/370; 428/375; 428/389; 442/352; 442/364; 442/409; 156/181; 156/308.2

[58] Field of Search ..... 428/370, 373, 428/374, 397, 375, 389; 442/335, 361, 362, 364, 409; 156/181, 308.2

[56] References Cited

U.S. PATENT DOCUMENTS 5,349,028 9/1994 Takahashi et al. ..... 525/440

FOREIGN PATENT DOCUMENTS 3-249208 11/1991 Japan .
5-331315 12/1993 Japan .
6-93516 4/1994 Japan .
6-248518 9/1994 Japan .
6-508868 10/1994 Japan .

*Primary Examiner*—Terrel Morris
*Assistant Examiner*—Cheryl Juska
*Attorney, Agent, or Firm*—McDermott, Will & Emery

[57] ABSTRACT

There is disclosed a biodegradable composite fiber comprising a first component consisting of a single component fiber produced by melt-spinning a biodegradable polymer composition consisting of a starch-based polymer, a partially hydrolyzed copolymer of vinyl acetate and an unsaturated monomer containing no functional groups, an aliphatic polyester, a decomposition accelerating agent, and a plasticizer, or such a biodegradable polymer composition; and a second component consisting of an aliphatic polyester, in which the first component is present continuously in the lengthwise direction over at least a part of the surface of the fiber of the second component, and there is also disclosed a non-woven fabric, a knitted fabric, and a molded article produced from this fiber.

15 Claims, No Drawings

BIODEGRADABLE FIBER AND NON-WOVEN FABRIC

TECHNICAL FIELD

The present invention relates to a single component fiber and a composite fiber made of a biodegradable polymer, as well as to a non-woven fabric, a knitted fabric, and a molded article made of these fibers.

BACKGROUND ART

Heretofore, there have been known biodegradable fibers consisting of natural materials, such as rayon, cupra (cuprammonium rayon), chitin, chitosan, and collagen, and more recently, there have been known fibers produced from biodegradable polymers consisting of aliphatic polyesters such as poly-ϵ-caprolactone. Although by definition these biodegradable fibers decay when placed in the natural environment, it takes a long time until the form of fibers disappears completely. Therefore, they may create the same environmental problems as those created by fibers such as polyamides, polyesters, and polypropylene which are little decayed.

In order to solve such problems, it is necessary to degrade and decompose fibers more quickly.

As a known example of fibers containing starch, Japanese Patent Application Laid-open No. 4-100913 discloses a biodegradable fiber consisting of a polyvinyl alcohol-based polymer and starch. However, this fiber is slightly biodegradable, and complete decomposition takes a long time.

It is an object of the present invention to solve such problems, and to provide a biodegradable, adhesive composite fiber, a non-woven fabric, a knitted fabric, a fiber composition, and the like.

DISCLOSURE OF THE INVENTION

The inventors of the present invention conducted repeated examinations for solving the above problems, and found that the above object was achieved by a fiber formed by melt-spinning a certain biodegradable polymer composition. The present invention has the constitution described below.

According to a first aspect of the present invention, there is provided a biodegradable fiber comprising a melt-spun biodegradable polymer composition consisting of the following components (A), (B), (C), and (D):

(A) a starch-based polymer, (30–70 percent by weight)

(B) a partially hydrolyzed copolymer of vinyl acetate and an unsaturated monomer containing no functional groups, and an aliphatic polyester (30–70 percent by weight in total)

(C) a decomposition accelerating agent (0–5 percent by weight), and (D) a plasticizer (0–15 percent by weight).

According to a second aspect of the present invention, there is provided a biodegradable fiber according to the first aspect, wherein the component (B) of said biodegradable polymer composition consists of a partially hydrolyzed copolymer of vinyl acetate and an unsaturated monomer containing no functional groups (30–70 percent by weight of the fiber), and an aliphatic polyester (0–40 percent by weight).

According to a third aspect of the present invention, there is provided a biodegradable fiber according to the first or second aspect, wherein the biodegradable polymer composition consists of a starch-based polymer, and a partially hydrolyzed copolymer of vinyl acetate and an unsaturated monomer containing no functional groups.

According to a fourth aspect of the present invention, there is provided a biodegradable fiber according to the first or second aspect, wherein the unsaturated monomer containing no functional groups is at least one selected from a group consisting of ethylene, propylene, isobutylene, and styrene; the saponification degree of said partially hydrolyzed copolymer is 78–98 percent, and the content of the partially hydrolyzed copolymer in the fiber is 30–70 percent by weight.

According to a fifth aspect of the present invention, there is provided a biodegradable fiber according to the first or second aspect, wherein the aliphatic polyester is at least one selected from a group of biodegradable thermoplastic polymers consisting of poly-ϵ-caprolactone, polylactic acid, polyglycolide, and hydroxyalkanoate.

According to a sixth aspect of the present invention, there is provided a biodegradable fiber according to the first or second aspect, wherein the decomposition accelerating agent is at least one selected from a group consisting of organic peroxides, inorganic peroxides, photo sensitizers, and photo-decomposable polymer compounds.

According to a seventh aspect of the present invention, there is provided a non-woven fabric produced from a biodegradable fiber according to the first or second aspect.

According to an eighth aspect of the present invention, there is provided a knitted fabric produced from a biodegradable fiber according to the first or second aspect.

According to a ninth aspect of the present invention, there is provided a molded article produced from a biodegradable fiber according to the first or second aspect.

According to a tenth aspect of the present invention, there is provided a biodegradable composite fiber comprising a biodegradable polymer composition consisting of the following components (A), (B), (C), and (D) as the first component, and an aliphatic polyester as the second component, the first component being arranged as a side-by-side or sheath-and-core type so as to be present sequentially along the lengthwise direction on at least a part of the surface of said fiber:

(A) a starch-based polymer (30–70 percent by weight), (B) a partially hydrolyzed copolymer of vinyl acetate and an unsaturated monomer containing no functional groups, and an aliphatic polyester (30–70 percent by weight in total), (C) a decomposition accelerating agent (0–5 percent by weight), and (D) a plasticizer (0–15 percent by weight).

According to an eleventh aspect of the present invention, there is provided a biodegradable composite fiber according to claim 10, wherein the component (B) of the biodegradable polymer composition consists of a partially hydrolyzed copolymer of vinyl acetate and an unsaturated monomer containing no functional groups (30–70 percent by weight of the fiber), and an aliphatic polyester (0–40 percent by weight).

According to a twelfth aspect of the present invention, there is provided a biodegradable composite fiber according to the tenth or eleventh aspect, wherein said unsaturated monomer containing no functional groups is at least one selected from a group consisting of ethylene, propylene, isobutylene, and styrene, the saponification degree of said partially hydrolyzed copolymer is 78–98 percent, and the content of the partially hydrolyzed copolymer in said fiber is 30–70 percent by weight.

According to a thirteenth aspect of the present invention, there is provided a biodegradable composite fiber according to the tenth or eleventh aspect, wherein said aliphatic polyester is at least one selected from a group of biodegradable thermoplastic polymers consisting of poly-ε-caprolactone, polylactic acid, polyglycolide, and hydroxyalkanoate.

According to a fourteenth aspect of the present invention, there is provided a biodegradable composite fiber according to the tenth or eleventh aspect, wherein the decomposition accelerating agent is at least one selected from a group consisting of organic peroxides, inorganic peroxides, photo sensitizers, and photo-decomposable polymer compounds.

According to a fifteenth aspect of the present invention, there is provided a biodegradable composite fiber according to the tenth or eleventh aspect, wherein at least one of the first and second components has a profiled cross-section.

According to a sixteenth aspect of the present invention, there is provided a biodegradable composite fiber according to the tenth or eleventh aspect, wherein the surface of said fiber is treated by a metal alkyl phosphate.

According to a seventeenth aspect of the present invention, there is provided a process for producing a non-woven fabric comprising a step of softening the surface of a biodegradable fiber according to the tenth or eleventh aspect by applying moisture to said surface.

According to an eighteenth aspect of the present invention, there is provided a biodegradable composite fiber according to the tenth or eleventh aspect, wherein said a fiber is crimped.

According to a nineteenth aspect of the present invention, there is provided a non-woven fabric produced from a biodegradable composite fiber according to the tenth or eleventh aspect.

According to a twentieth aspect of the present invention, there is provided a knitted fabric produced from a biodegradable composite fiber according to the tenth or eleventh aspect.

According to a twenty-first aspect of the present invention, there is provided a molded article produced from a biodegradable composite fiber according to the tenth or eleventh aspect.

The present invention will be described in detail below.

First, a biodegradable polymer composition used as the first component of single component fibers which mean fibers except composite fibers, or composite fibers will be described. The biodegradable polymer composition comprises a starch-based polymer, a partially hydrolyzed copolymer of vinyl acetate and an unsaturated monomer containing no functional groups, an aliphatic polyester, a decomposition accelerating agent, and a plasticizer.

The starch-based polymers used in the present invention include chemically modified starch derivatives (allyl-etherified starch, carboxymethyl-etherified starch, hydroxyethyl-etherified starch, hydroxypropyl-etherified starch, methyl-etherified starch, phosphoric acid-cross-linked starch, formaldehyde-cross linked starch, epichiorohydrin-cross-linked starch, acrolein-cross linked starch, acetocetic-esterfied starch, acetic-esterified starch, succinic-esterified starch, xanthic-esterified starch, nitric-esterified starch, urea phosphoric-esterified starch, phosphoric-esterified starch); chemically decomposed starch (dialdehyde starch, acid-treated starch, hypochlorous acid-oxidized starch, etc.); enzyme-modified starch (hydrolyzed dextrin, enzyme-decomposed dextrin, amylose, etc.); physically modified starch (a-starch, fractionated amylose, moisture-and-heat-treated starch, etc.); raw starch (corn starch, bracken starch, arrowroot starch, potato starch, wheat starch, cassava starch, sago starch, tapioca starch, millet starch, bean starch, lotus-root starch, water-chestnut starch, sweet-potato starch, etc.). Among these, potato starch, corn starch, and wheat starch are particularly preferred. At least one of the starch-based polymers mentioned above can be used. From the viewpoint of processability, preferably there is used thermally modified starch, prepared by the heat treatment of starch having a 5–30 percent moisture content by weight in a closed space at a high temperature of, for example, 80–290° C., under a high pressure of 60–300 MPa while the moisture content is maintained to form a uniform melt.

The partially hydrolyzed copolymer of vinyl acetate and an unsaturated monomer containing no functional groups (hereafter called "hydrolyzed copolymer") is at least one selected from a group consisting of copolymers formed by the copolymerization of vinyl acetate and an unsaturated monomer consisting of a hydrocarbon containing no functional groups, in which there coexists vinyl alcohol units obtained by partially hydrolyzing vinyl ester groups of the resulting copolymer, vinyl acetate units that have not decomposed, and unsaturated monomer units. Unsaturated monomers containing no functional groups comprise at least one selected from a group consisting of ethylene, propylene, isobutylene, and styrene.

Among these hydrolyzed copolymers, a partially saponified ethylene-vinyl acetate copolymer is preferably used. A copolymer of a saponification degree between 78 and 98 percent is particularly preferred.

Examples of aliphatic polyesters used in the present invention include polymers of glycol acid or lactic acid or copolymers thereof (poly-α-hydroxyl acid); polylactones such as poly-ε-caprolactone and poly-β-propiolactone; polyhydroxy alkanoates such as poly-3-hydroxy propionate, poly-3-hydroxy butylate, poly-3-hydroxy caproate, poly-3-hydroxy heptanoate, poly-3-hydroxy valerate, poly4hydroxy butylate; and copolymers formed by reactions between these materials. Examples of polycondensation products of glycols and dicarboxylic acids include polyethylene oxalate, polyethylene succinate, polyethylene adipate, polyethylene azelate, polybutylene oxalate, polybutylene succinate, polybutylene adipate, polybutylene sebacate, polyhexamethylene sebacate, polyneopentyl oxalate, and copolymers formed by reactions between these materials (monomers).

Examples of aliphatic polyesters further include aliphatic polyester amide polymers, which are co-polycondensation products of materials (monomers) constituting the above aliphatic polyesters with materials (monomers) constituting aliphatic polyamides such as polycapramide (also known as nylon 6), polytetramethylene adipamide (also known as nylon 46), polyhexamethylene adipamide (also known as nylon 66), and polyundecanamide (also known as nylon 12). Among these, polyglycolides such as poly-ε-caprolactone, polylactic acid, and polybutylene succinate, or hydroxy alkanoate such as poly-3-hydroxy butylate is particularly preferred.

Additives for accelerating the decomposition of polymers include, for example, organic peroxides such as benzoyl peroxide, lauryl peroxide, cumene hydroperoxide, and t-butyl peroxide; inorganic oxidants such as potassium persulfate, sodium persulfate, and ammonium persulfate; and photosensitizers such as benzophenone, metal chelates, and aromatic ketones.

Plasticizers used in the present invention include the following glycols, and the compounds of ethanolamine or water and the like. Examples of glycols include ethylene glycol, trimethylene glycol, tetramethylene glycol, pentamethylene glycol, hexamethylene glycol, propylene glycol, glycerin, 2,3-butadiene diol, 1,3-butane diol, diethylene glycol, triethylene glycol, 1,7-heptane diol, cyclohexane-1,2-diol, cyclohexane-1,4-diol, pinacol, hydrobenzoin, and benzpinacol.

As described above, the biodegradable polymer composition of the present invention comprises (A) a starch-based polymer, (B) a hydrolyzed copolymer and an aliphatic polyester, (C) a decomposition accelerating agent, and (D) a plasticizer and the like. In a preferred embodiment of the present invention, the content of the component (A) is 30–70 percent by weight, the combined content of the hydrolyzed copolymer and the aliphatic polyester in the component (B) is 30–70 percent by weight, (more preferably, 30–70 percent by weight of the fiber a hydrolyzed copolymer and 0–40 percent by weight an aliphatic polyester), the content of the component (C) is 0–5 percent by weight (0.02 to 5 percent by weight to enhance the effect of addition), and the content of the component (D) is within a range between 0 and 15 percent by weight.

The essential components of the biodegradable polymer composition used in the present invention are a starch-based polymer and a hydrolyzed copolymer, and a biodegradable polymer composition can be produced from only these two types of compounds.

In the present invention, various additives such as delustrants, pigments, light stabilizers, heat stabilizer and antioxidants may be added to the biodegradable thermoplastic polymer described above within a range that does not reduce the advantages of the present invention.

The single biodegradable fiber of the present invention is produced by spinning the biodegradable polymer composition described above through use of melt spinning or spunbond methods, and by stretching and crimping as required to form a biodegradable fiber. The fineness of the fiber is approximately 0.5 to 1000 d/f for staples or multifilaments, and approximately 50 to 5000 d/f for monofilaments.

A fiber post-treated by a surface-treatment agent such as potassium salt of lauryl phosphate has color fastness to gases in addition to the effects described above.

The composite fiber of the present invention uses the biodegradable polymer composition described above as the first component, and the aliphatic polyester described above as the second component. Various additives such as decomposition accelerating agent, delustrants, pigments, light stabilizers, heat stabilizer and antioxidants may be added to the biodegradable thermoplastic polymer described above within a range that does not reduce the advantages of the present invention.

The ratio of the first and second components may be adjusted so that the polymer composition of the first component can be present continuously in the lengthwise direction over at least a part of the surface of the fiber of the second component. However, when composite spinning is used for forming the fiber of the present invention, the ratio (weight ratio) of the second component to the first component is preferably between 30/70 and 70/30. The ratio may be selected in consideration of the ease of spinning, or the ease of forming non-woven fabrics.

The biodegradable composite fiber of the present invention is produced by side-by-side or sheath-and core type composite spinning, and is stretched or crimped as required. The biodegradable composite fiber of the present invention may also be produced by side-by-side or sheath-and core type composite spun-bonding. Although the cross-sectional shape of the fiber may normally be circular, it may be modified to profiled in consideration of the feel or other properties when the fiber is used for producing non-woven fabrics. The fineness of the fiber is approximately 0.5 to 1000 d/f for staples and multifilaments, and approximately 50 to 5000 d/f for monofilaments.

Although melt spinning is generally a spinning method of high cost performance, spinning starch-based polymers through use of melt spinning is said to be very difficult. As a method to improve this, in certain cases non-biodegradable general-purpose polymers, such as polyethylene, are blended with starch-based polymers. However, since such polymers are not completely decomposed in the natural world, environmental problems may arise. Such disadvantages can be eliminated to some extent by using the biodegradable polymer composition used in the present invention, enabling the manufacture of a biodegradable fiber comprising a single component fiber.

In order to achieve more stable spinning, however, the present invention also provides a biodegradable fiber produced by composite spinning. Specifically, the biodegradable fiber of the present invention is produced by forming the core of the fiber from an aliphatic polyester having some biodegradability and rather high spinnability as the second component, the surface of which is coated by a biodegradable polymer composition containing a starch-based polymer having high biodegradability.

The reason why a hydrolyzed polymer and an aliphatic polyester are combined in the biodegradable polymer composition is to further improve the spinnability of the starch-based polymer.

Compared with fibers comprising an aliphatic polyester alone, the biodegradable composite fiber of the present invention has higher biodegradability, and solves the problem of difficulty in melt-spinning starch-based polymers.

The disadvantage of starch-based polymers is discoloration caused by exposure to the air for a long period of time. In some uses such discoloration may lower the product value. In the present invention, resistance to gas discoloration has been improved through deposition of a surface treatment agent made of a metal salt of alkyl phosphate such as the potassium salt of lauryl phosphate. The amount of such a surface treatment agent is 0.05 to 3 percent by weight, preferably 0.1 to 2.5 percent by weight, and more preferably 0.15 to 1.5 percent by weight.

Next, the process for producing a non-woven fabric according to the present invention will be described. When a biodegradable fiber of the present invention comprising single or composite fibers is used as a staple, the raw stock is carded through use of a carding machine to form a web, which is then heat-treated to partially heat-bond the constituent fibers to each other. This partial heat bonding may be performed by known heat bonding processes. Alternatively, the web may be entangled three-dimensionally. This three-dimensional entanglement may be produced by a known method known as the high pressure fluid flow process, or through use of a needle punching non-woven fabric machine. Through such partial heat bonding or three-dimensional entanglement, the form of a non-woven fabric is maintained. The heating temperature is set at or above a temperature at which the biodegradable polymer composition melts or softens to become flowable. In the case of a composite fiber, a non-woven fabric with good feel is obtained when it is heat-treated at or below the melting point of the polyester which serves as the second component of the fiber. The non-woven fabric of the present invention is composed of the biodegradable fiber described above, in which the constituent fibers are bonded partially to each other or entangled three-dimensionally, or entangled three-dimensionally and bonded partially.

The heat treatment of the web may be performed by known methods. For example, there may be used a method to pass the web between rollers consisting of a heated emboss roller and a flat metal roller, a method using a heat dryer, or a method using an ultrasonic bonding machine.

For the high pressure fluid flow treatment of the web, any known methods may be used. For example, equipment in which a large number of ejecting holes of a pore diameter of 0.01 to 1.0 mm, preferably 0.1 to 0.4 mm are arranged is used for ejecting high pressure liquid of an ejection pressure of 5 to 150 kgf/cm$^2$. The ejecting holes are arrayed in line in the direction perpendicular to the web traveling direction. This treatment may be performed on one surface or both surfaces of the web. Especially in the case of one surface treatment, if the ejecting holes are arrayed in more than one row, and the ejecting pressure is decreased in the early rows and increased in the later rows, a non-woven fabric of uniform dense entanglement and uniform feel can be obtained. As the high pressure liquid, cold or warm water is usually used. The distance between the ejecting holes and the web should be as short as possible.

This high pressure liquid flow treatment may be a sequential or separate process. After the high pressure liquid flow treatment has been performed, excessive water is removed from the web. The excessive water can be removed through use of any known methods. For example, after the excessive water is removed to some extent through use of squeezing equipment such as a mangle roll, remaining water is removed through use of a dryer such as a continuous hot-air dryer.

In addition to heat-bonding, processes for manufacturing non-woven fabrics from the biodegradable fiber of the present invention include a method in which moisture is applied onto the surface of fibers, and dried by a suitable method to adhere the intersections of the fibers to form a non-woven fabric. This process is economical since heat energy can be saved in relation to the heat-bonding method.

The biodegradable fiber of the present invention may be combined with other fibers, such as rayon, pulp, cuprammonium rayon, chitin, chitosan, collagen, cotton, linen, and silk to form non-woven fabrics.

Also, the web containing the fiber of the present invention may be heat-bonded to form molded articles.

Furthermore, when the fiber is used for producing knitted fabrics, it may be used after heat-bonding the intersections of fibers constituting the knitted fabrics.

When molded articles are produced, non-woven fabrics or knitted fabrics containing the biodegradable fiber of the present invention may be used after being cut into various three-dimensional shapes.

When the biodegradable fiber of the present invention is used as a filament, this fiber may be used alone, or combined with other fibers as described above, to form knitted fabrics.

Industrial Applicability

After suitable processing, the primary products made of the biodegradable fiber of the present invention are used as environmental-friendly products including household goods such as paper diapers, bandages, disposable underwear, personal hygiene products, kitchen sink filters, and garbage bags; civil-engineering materials such as draining materials; agricultural goods such as root protecting cloth and seedling raising beds; and filters for various fields.

The present invention will be described specifically by referring to preferred embodiments. Biodegradability of each example was measured as follows: Biodegradability: As samples, a 2.5 cm×30 cm pieces of point-bonded non-woven fabric of a weight per unit area of 60 g/m$^2$, or 10 g of a fiber were used. These samples were put in a coarse net made of polyethylene/polypropylene sheath-and-core-type monofilaments, immersed in (1) sludge, (2) soil, (3) sea water, or (4) fresh water for one month, then rinsed with flowing water, dried, and weighed. The shortest period until the weight of the sample became ½ the initial weight or less was defined as the half life of degradation.

EXAMPLE 1

A biodegradable polymer composition comprising 60 percent by weight of thermally modified corn starch having a water content of 10 percent by weight, and 40 percent by weight of a hydrolyzed copolymer of a saponification degree of 92 percent produced by saponifying a copolymer consisting of 30 mol percent of ethylene and 70 mol percent of vinyl acetate, was pelletized.

This composition was melt-spun through use of a spinneret having 350 holes of a diameter of 0.8 mm and a fill-flight screw of a compression ratio of 2.0, at a spinning temperature of 140° C., and a regular yarn of a fineness of 7 d/f was formed. As a surface finishing agent, potassium lauryl phosphate was deposited in an amount of 0.3 percent by weight relative to the weight of the fiber.

After this yam was cold-drawn at a drawing ratio of 1.2, it was crimped through use of a crimper to make 12 crimps per 25 mm. This tow was cut through use of a cutter, and a biodegradable fiber of a single component fiber fineness of 6 d/f and a fiber length of 38 mm was obtained. This biodegradable fiber was carded through use of a carding machine to form a carded web. This web was processed into a non-woven fabric through use of an emboss roll at a temperature of 130° C. to form a non-woven fabric of a weight per unit area of 60 g/m$^2$. This sample was buried in activated sludge and the like to measure the half life of biodegradation of the non-woven fabric. The results are shown in Table 1.

EXAMPLE 2

Single fiber of a fineness of 7 d/f was produced as in Example 1 by melt spinning at 140° C. a granulated composition comprising 55 percent by weight of thermally modified corn starch, 35 percent by weight of poly-ε-caprolactone having a melting point of 60° C. and a melt flow rate of 60 (g/10 min. at 190° C.), 8 percent by weight of water as a plasticizer, and 2 percent by weight of glycerin. As a surface finishing agent, potassium lauryl phosphate was deposited in an amount of 0.3 percent by weight relative to the weight of the fiber. The yarn was drawn and crimped under the same condition as in Example 1 to obtain a biodegradable fiber having a single fiber fineness of 6 d/f and a fiber length of 38 mm. This fiber was processed into a non-woven fabric of a weight per unit area of 60 g/m$^2$ as in Example 1, and the halflife of degradation of the non-woven fabric was measured. The results are shown in Table 1.

COMPARATIVE EXAMPLE 1

Since the polymer composition in this experiment was difficult to melt-spin, the following method was used for spinning.

A stock solution was prepared by mixing 15 percent by weight of corn starch and 85 percent by weight of polyvinyl alcohol, and suspending the mixture in water to make the total polymer content 20 percent by weight. The stock solution was ejected through a spinneret having 350 holes of a diameter of 0.8 mm into an atmosphere of a temperature of approximately 120° C. to remove the solvent water, cold-drawn at a drawing ratio of 1.2, and crimped through use of a crimper to make 12 crimps per 25 mm. This tow was cut through use of a cutter, and biodegradable staples of a single fiber fineness of 6 d/f, and a fiber length of 38 mm were obtained. As in Example 1, these staples were processed into a non-woven fabric of a weight per unit area of 60 g/m$^2$, and the biodegradability of the non-woven fabric was evaluated. The results are shown in Table 1.

COMPARATIVE EXAMPLE 2

Biodegradable polybutylene succinate of a melt flow rate of 14 (g/10 min. at 2.16 kgf, 190° C., measured in accordance with JIS K-7210) and a melting point of 114° C. was melt spun under the following conditions.

This composition was melt-spun through use of a spinneret having 350 holes of a diameter of 0.8 mm and a full-flight screw of a compression ratio of 2.0, at a spinning temperature of 210° C., and a regular yarn of a fineness of 7 df was formed. As a surface finishing agent, potassium lauryl phosphate was deposited in an amount of 0.3 percent by weight relative to the weight of the fiber. After this yarn was cold-drawn at a drawing ratio of 1.2, it was crimped through use of a crimper to make 12 crimps per 25 mm. This tow was cut through use of a cutter, and self-degradable staples of a single fiber fineness of 6 d/f, and a fiber length of 38 mm were obtained. These staples were carded through use of a carding machine to form a carded web, and a non-woven fabric of a weight per unit area of 60 g/m$^2$ was formed in the same manner as in Example 1. This sample was evaluated for biodegradability. The results are shown in Table 1.

The results of biodegradability evaluation show that under all conditions the weight of the fiber of Example 1 decreased to ½ or less in 4 months. The fiber of Comparative Example 1 had biodegradability similar to that of the fiber of Example 1, but was difficult to melt-spin. The fiber of Comparative Example 2 had poor biodegradability in that it took 20 months or more for weight decrease.

TABLE 1

| | Half-life of biodegradation in different environments | | | | |
|---|---|---|---|---|---|
| | In soil | In sludge | In sea water | In fresh water | Melt-spinning properties |
| Example 1 | 4 months | 2 months | 3 months | 4 months | Good |
| Example 2 | 6 months | 4 months | 3 months | 4 months | Good |
| Comp. Ex. 1 | 4 months | 2 months | 3 months | 4 months | Poor |
| Comp. Ex. 2 | 16 months | 8 months | 12 months | 20 months | Good |

EXAMPLE 3

A biodegradable polymer composition comprising 50 percent by weight of thermally modified corn starch, 40 percent by weight of a hydrolyzed copolymer of a saponification degree of 90 percent produced by saponifying a copolymer consisting of 30 mol percent of ethylene and 70 mol percent of vinyl acetate, and 10 percent by weight of water as a plasticizer was pelletized and used as the sheath component; and polybutylene succinate of a melt flow rate of 14 (g/10 min. at 2.16 kgf, 190° C.) and a melting point of 114° C. was used as the core component. These were melt-spun through use of a spinneret having 350 holes of a diameter of 0.8 mm at a spinning temperature of 140° C., and under a condition of a sheath/core ratio of 1/1 by weight to form an undrawn yam of a fineness of 7 d/f. As a surface finishing agent, potassium lauryl phosphate was deposited in an amount of 0.3 percent by weight relative to the weight of the fiber. After this yam was cold-drawn at a drawing ratio of 1.2, it was crimped through use of a crimper to make 12 crimps per 25 mm, and was cut to a length of 38 mm to form a composite fiber of a single fiber fineness of 6 d/f. This fiber was buried in activated sludge and other media to measure the half-life of biodegradation of the fiber. The results are shown in Table 2.

EXAMPLE 4

The biodegradable composite fiber produced in Example 3 was used as raw stock to form a web through use of a carding machine. This web was processed through use of an air-through processor at 140° C. into a non-woven fabric of a weight per unit area of 60 g/m$^2$. This non-woven fabric was buried in activated sludge and other media to measure the half-life of biodegradation of the fiber. The results are shown in Table 2.

EXAMPLE 5

The biodegradable fiber obtained in Example 3 and rayon of a fineness of 1.5 d/f and a fiber length of 51 mm were mixed at a weight ratio of 1/1, and used as raw stock to form a web through use of a carding machine. After water flow was ejected onto this web, the intersections of the fibers were bonded to form a non-woven fabric of a weight per unit area of 60 g/m$^2$. This non-woven fabric was buried in activated sludge and other media to measure the half life of biodegradation of the fiber. The results are shown in Table 2.

EXAMPLE 6

A biodegradable polymer composition comprising 50 percent by weight of thermally modified corn starch, 40 percent by weight of a hydrolyzed copolymer of a saponification degree of 90 percent produced by saponifying a copolymer consisting of 30 mol percent of ethylene and 70 mol percent of vinyl acetate, 8 percent by weight of water as a plasticizer, and 2 percent by weight of glycerin as another plasticizer was pelletized and used as the sheath component, and polybutylene succinate having a melt flow rate of 14 (g/10 min. at 2.16 kgf, 190° C.) and a melting point of 114° C. was used as the core component. These were melt-spun through use of a spinneret having 350 holes of a diameter of 0.8 mm at a spinning temperature of 140° C., and under a condition of a sheath/core ratio of 1/1 by weight to form an undrawn yarn of a fineness of 7 d/f. As a surface finishing agent, potassium lauryl phosphate was deposited in an amount of 0.3 percent by weight relative to the weight of the fiber. After this yarn was cold-drawn at a drawing ratio of 1.2, it was crimped through use of a crimper to make 12 crimps per 25 mnm, and was cut to a length of 38 mm to form a composite fiber of a single fiber fineness of 6 d/f. This fiber was buried in activated sludge and other media to measure the half life of biodegradation of the fiber. The results are shown in Table 2.

EXAMPLE 7

The biodegradable composite fiber produced in Example 6 was used as the raw stock to form a web through use of a carding machine. Through use of an air-through processor at 140° C. this web was processed into a non-woven fabric of a weight per unit area of 60 $gm^2$. This non-woven fabric was buried in activated sludge and other media to measure the half life of biodegradation of the fiber. The results are shown in Table 2.

EXAMPLE 8

A biodegradable polymer composition comprising 50 percent by weight of thermally modified corn starch, 40 percent by weight of a hydrolyzed copolymer of a saponification degree of 90 percent produced by saponifying a copolymer consisting of 30 mol percent of ethylene and 70 mol percent of vinyl acetate, 8 percent by weight of water as a plasticizer, and 2 percent by weight of glycerin as another plasticizer was pelletized and used as the sheath component; and polybutylene succinate having a melt flow rate of 14 (g/10 min. at 2.16 kgf, 190° C.) and a melting point of 114° C. was used as the core component. These were melt-spun through use of a spinneret having a modified cross-section and having 350 holes of a diameter of 1.0 mm at a spinning temperature of 140° C., and under a condition of a sheath/core ratio of 1/1 by weight to form an undrawn yarn of a fineness of 7 d/f The cross-sections of fiber extruded from the spinneret having a modified cross-section were Y-shaped for the core and circular for the sheath. As a surface finishing agent, potassium lauryl phosphate was deposited in an amount of 0.3 percent by weight relative to the weight of the fiber.

After this yarn was cold-drawn at a drawing ratio of 1.2, it was crimped through use of a crimper to make 12 crimps per 25 mm, and was cut to a length of 38 mm to form a composite fiber of a single fiber fineness of 6 d/f. This fiber was buried in activated sludge and other media to measure the half-life of biodegradation of the fiber. The results are shown in Table 2.

EXAMPLE 9

A biodegradable polymer composition comprising 50 percent by weight of thermally modified corn starch, 8 percent by weight of water and 2 percent by weight of glycerin as plasticizers, and 40 percent by weight of polyethylene succinate having a melt flow rate of 14 (g/10 min. at 2.16 kgf, 190° C.) and a melting point of 95° C. was pelletized and used as the sheath component, and polybutylene succinate used in Example 8 and other examples was used as the core component. These were melt-spun through use of a spinneret having 350 holes of a diameter of 1.0 mm at a spinning temperature of 140° C., and under a condition of a sheath/core ratio of 1/1 by weight to form an undrawn yarn of a fineness of 7 d/f. This fiber was drawn and crimped under the same conditions as in Example 1 to form a composite fiber of a single fiber fineness of 6 d/f The results of the biodegradability test of this fiber are shown in Table 2.

COMPARATIVE EXAMPLE 3

Polyethylene succinate of a melt flow rate of 14 (g/10 min. at 2.16 kgf, 190° C.) and a melting point of 95° C. was used as the sheath component; and polybutylene succinate of a melting point of 114° C. was used as the core component, and these were melt-spun through use of a spinneret having 350 holes of a diameter of 0.8 mm at a spinning temperature of 140° C., and under a condition of a sheath/core ratio of 1/1 by weight to form an undrawn yarn of a fineness of 7 d/f. As a surface finishing agent, potassium lauryl phosphate was deposited in an amount of 0.3 percent by weight relative to the weight of the fiber. After this yarn was cold-drawn at a drawing ratio of 1.2, it was crimped through use of a crimper to make 12 crimps per 25 mm, and was cut to a length of 38 mm to form a composite fiber of a single fiber fineness of 6 d/f. This fiber was buried in activated sludge and other media to measure the half-life of biodegradation of the fiber. The results are shown in Table 2.

COMPARATIVE EXAMPLE 4

The biodegradable composite fiber produced in Comparative Example 3 was used as raw stock to form a web through use of a carding machine. Through use of is an air-through processor at 100° C. this web was processed into a non-woven fabric of a weight per unit area of 60 $g/m^2$. This non-woven fabric was buried in activated sludge and other media to evaluate biodegradability.

Table 2 shows that all of fibers produced in Examples 3, 6, 8, 9, and Comparative Example 3 had good spinnability. Although the processability into non-woven fabrics of fibers of Examples 4, 5, and 7 was good, that of the fiber of Comparative Example 4 was fair. All of fibers produced in Examples 3 and 6, and non-woven fabrics produced from these fibers were colored little. The results of biodegradability evaluation show that the weight of all fibers produced in Examples 3, 6, and 9 was halved within one year, whereas the fiber produced in Comparative Example 3 required more than one year for biodegradation. Non-woven fabrics produced in the above Examples were biodegraded quickly. Fibers comprising only polyesters of Comparative Examples 3 and 4, and non-woven fabrics produced from these fibers had poorer biodegradability than did fibers and non-woven fabrics according to the present invention.

TABLE 2

| | Half-life of biodegradation (months) | | | | Performance | |
|---|---|---|---|---|---|---|
| | In soil | In sludge | In sea water | In fresh water | Spinning | Non-woven processability |
| Example 3 | 8 | 4 | 6 | 10 | Good | |
| Example 4 | 8 | 4 | 6 | 10 | | Good |

TABLE 2-continued

| | Half-life of biodegradation (months) | | | | Performance | |
|---|---|---|---|---|---|---|
| | In soil | In sludge | In sea water | In fresh water | Spinning | Non-woven processability |
| Example 5 | 10 | 7 | 8 | 10 | | Good |
| Example 6 | 8 | 4 | 6 | 10 | Good | |
| Example 7 | 8 | 4 | 6 | 10 | | Good |
| Example 8 | 7 | 3 | 4 | 8 | Good | |
| Example 9 | 9 | 4 | 6 | 10 | Good | |
| Comp. Ex. 3 | 16 | 8 | 12 | 20 | Good | |
| Comp. Ex. 4 | 17 | 9 | 12 | 20 | | Fair |

The biodegradable composite fiber of the present invention can be produced economically in large quantities, and biodegraded within a very short period in various environments, such as in soil, sludge, sea water, or fresh water. The fiber can also be easily processed into non-woven fabrics by heating or moistening, or into knitted fabrics and molded articles. These products show similarly high biodegradability. According to the present invention, therefore, environment-friendly biodegradable fibers and products produced from these fibers can be provided economically, and the practical significance of the present invention is large.

We claim:

1. A biodegradable composite fiber comprising a core component comprising of a biodegradable aliphatic polyester and a sheath component surrounding said core component comprising a biodegradable polymer composition comprising a starch-based polymer and a polymer selected from the group consisting of an aliphatic polyester, a partially hydrolyzed copolymer of vinyl acetate and an unsaturated monomer containing no functional groups, and mixtures thereof, wherein the surface of the sheath component is treated with a metal salt of an alkyl phosphate to control discoloration of the starch-based polymer by air.

2. A biodegradable composite fiber according to claim 1 wherein said unsaturated monomer is selected from the group consisting of ethylene, propylene, isobutylene and styrene.

3. A biodegradable composite fiber according to claims 1 wherein the saponification degree of said partially hydrolyzed copolymer is 78–98 percent.

4. A biodegradable composite fiber according to claim 1 wherein the content of said copolymer in said sheath component is 30–70 percent by weight.

5. A biodegradable composite fiber according to claim 1 wherein said starch-based polymer further includes a decomposition accelerating agent and a plasticizer.

6. A biodegradable composite fiber according to claim 5 wherein said decomposition accelerating agent is at least one compound selected from the group consisting of organic peroxides, inorganic oxidants and photosensitizers.

7. A biodegradable composite fiber according to claim 1 wherein said aliphatic polyester is at least one polyester selected from the group consisting of poly-ϵ-caprolactone, polylactic acid and polybutylene succinate.

8. A biodegradable composite fiber according to claim 1 wherein said fiber is crimped.

9. A non-woven fabric produced from biodegradable composite fibers defined by claim 1.

10. A knitted fabric produced from biodegradable composite fibers defined by claim 1.

11. A molded article produced from biodegradable composite fibers defined by claim 1.

12. A process for producing a non-woven fabric comprising the steps of forming a web of fibers and bonding the fibers to form said non-woven fabric, wherein each of said fibers comprises a core component comprising of a biodegradable aliphatic polyester and a sheath component surrounding said core component comprising a biodegradable polymer composition comprising a starch-based polymer and a polymer selected from the group consisting of an aliphatic polyester, a partially hydrolyzed copolymer of vinyl acetate and an unsaturated monomer containing no functional groups, and mixtures thereof, the surface of said sheath component being treated with a metal salt of an alkyl phosphate to control discoloration of the starch-based polymer by air.

13. A process according to claim 12 wherein said bonding step is accomplished by heating said web of fibers to partially heat-bond the constituent fibers together.

14. A process according to claim 12 wherein said bonding step is accomplished by applying moisture to the surface of said fibers and drying the fibers to adhere the intersections of the fibers to each other.

15. A process according to claim 12 wherein said bonding step is accomplished by adding a liquid to said web of fibers from a high pressure fluid flow means and removing excess liquid from said web to produce a three dimentional entanglement of the fibers.

* * * * *